US011649819B2

(12) United States Patent
Gillispie

(10) Patent No.: US 11,649,819 B2
(45) Date of Patent: May 16, 2023

(54) PUMPING SYSTEMS WITH FLUID DENSITY AND FLOW RATE CONTROL

(71) Applicant: Halliburton Energy Services, Inc., Houston, TX (US)

(72) Inventor: Aric Martin Gillispie, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 44 days.

(21) Appl. No.: 17/256,823

(22) PCT Filed: Jul. 16, 2018

(86) PCT No.: PCT/US2018/042308

§ 371 (c)(1),
(2) Date: Dec. 29, 2020

(87) PCT Pub. No.: WO2020/018068

PCT Pub. Date: Jan. 23, 2020

(65) Prior Publication Data

US 2021/0156375 A1 May 27, 2021

(51) Int. Cl.
*F04B 49/22* (2006.01)
*E21B 43/26* (2006.01)
(Continued)

(52) U.S. Cl.
CPC ..... *F04B 49/22* (2013.01); *E21B 43/2607* (2020.05); *F04B 17/03* (2013.01); *F04B 23/02* (2013.01); *F04B 23/04* (2013.01)

(58) Field of Classification Search
CPC ..... F04B 15/00; F04B 15/02; F04B 17/00; F04B 17/03; F04B 17/06; F04B 23/00;
(Continued)

(56) References Cited

U.S. PATENT DOCUMENTS 4,654,802 A * 3/1987 Davis ..... B01F 35/2134 700/265
5,423,205 A 6/1995 Farchone
(Continued)

FOREIGN PATENT DOCUMENTS

WO 2016178956 A1 11/2016

OTHER PUBLICATIONS

International Search Report and Written Opinion for PCT application No. PCT/US2018/042308 dated Apr. 15, 2019, 9 pages.

*Primary Examiner* — Charles G Freay
*Assistant Examiner* — Chirag Jariwala
(74) *Attorney, Agent, or Firm* — Conley Rose, P.C.; Rodney B. Carroll

(57) ABSTRACT

A system includes a first plurality of pumps connected to draw from a clean fluid supply junction. A second plurality of pumps is operatively connected to a dirty fluid supply. A first valve is connected between the clean fluid supply junction and the dirty fluid supply for supplying clean fluid to the dirty fluid supply. A second valve is connected to feed a dirty fluid to the dirty fluid supply. A controller is operatively connected to the first and second valves and to the first and second pluralities of pumps for controlling downhole concentration and flow rate of proppant from the dirty fluid supply, wherein downhole concentration and flow rate are varied across a continuous spectrum.

20 Claims, 5 Drawing Sheets

(51) Int. Cl.
*F04B 17/03* (2006.01)
*F04B 23/04* (2006.01)
*F04B 23/02* (2006.01)

(58) Field of Classification Search
CPC ..... F04B 23/02; F04B 23/025; F04B 23/028; F04B 47/00; F04B 49/00; F04B 49/02; F04B 49/03; F04B 49/06; F04B 49/065; F04B 49/10; F04B 49/106; F04B 49/22; E21B 43/25; E21B 43/2607; C09K 8/02; C09K 8/04–28
See application file for complete search history.

(56) References Cited

U.S. PATENT DOCUMENTS 5,452,954 A * 9/1995 Handke ..... B28C 7/02 366/152.5
5,899,272 A * 5/1999 Loree ..... E21B 43/267 166/280.2
7,841,394 B2 11/2010 McNeel et al.
11,377,943 B2 7/2022 Kriebel et al.
2002/0048213 A1* 4/2002 Wilmer ..... G05D 11/135 366/136
2003/0031086 A1* 2/2003 Shikami ..... B01F 23/49 156/345.12
2003/0228830 A1* 12/2003 Sakai ..... B24B 57/02 451/8
2007/0277982 A1 12/2007 Shampine et al.
2009/0140444 A1* 6/2009 Smith ..... B01F 25/313311 261/77
2009/0157329 A1* 6/2009 Weightman ..... F04B 49/065 417/63
2009/0301725 A1 12/2009 Case et al.
2010/0046316 A1* 2/2010 Hughes ..... E21B 43/267 366/8
2010/0084023 A1* 4/2010 Melcer ..... H01L 21/67219 137/861
2010/0326663 A1* 12/2010 Bobier ..... F04B 47/00 166/307
2015/0096739 A1* 4/2015 Ghasripoor ..... F04F 13/00 166/177.5
2017/0016433 A1* 1/2017 Chong ..... F04B 49/065
2017/0114614 A1* 4/2017 Scharmach ..... E21B 43/267
2017/0260820 A1* 9/2017 Sehsah ..... E21B 21/106
2019/0120002 A1* 4/2019 Zhang ..... B08B 9/0433
2019/0233275 A1 8/2019 Carr et al.
2019/0316456 A1* 10/2019 Beisel ..... F04B 49/06

* cited by examiner

PUMPING SYSTEMS WITH FLUID DENSITY AND FLOW RATE CONTROL

BACKGROUND OF THE INVENTION

1. Field of the Invention

The present disclosure relates to pumping, and more particularly to pumping systems for controlling fluid density and flow rate such for use in delivering proppant downhole for hydraulic fracturing.

2. Description of Related Art

Proppant must be pumped at pressure into downhole earth formations to produce production fluids such as oil and gas in hydraulic fracturing operations. The proppant concentrations and flow rates must be controlled to achieve the intended effect, and typically multiple pumps are used for purposes of volume and redundancy. Multiple pumps feeding the downhole formation draw from a sources of clean and/or dirty fluid. The clean fluid can, for example, be water, and the dirty fluid can, for example, be a suspension of proppant. In some hydraulic fracturing operations a single pump or a plurality of pumps can be designated to pump only clean fluid or can be switched to pump proppant instead. When one pump fails, operators can compensate by manually adjusting the remaining pumps to maintain the desire concentration and flow rate of proppant into the downhole formation.

The conventional techniques have been considered satisfactory for their intended purpose. However, there is an ever present need for improved pumping systems. This disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
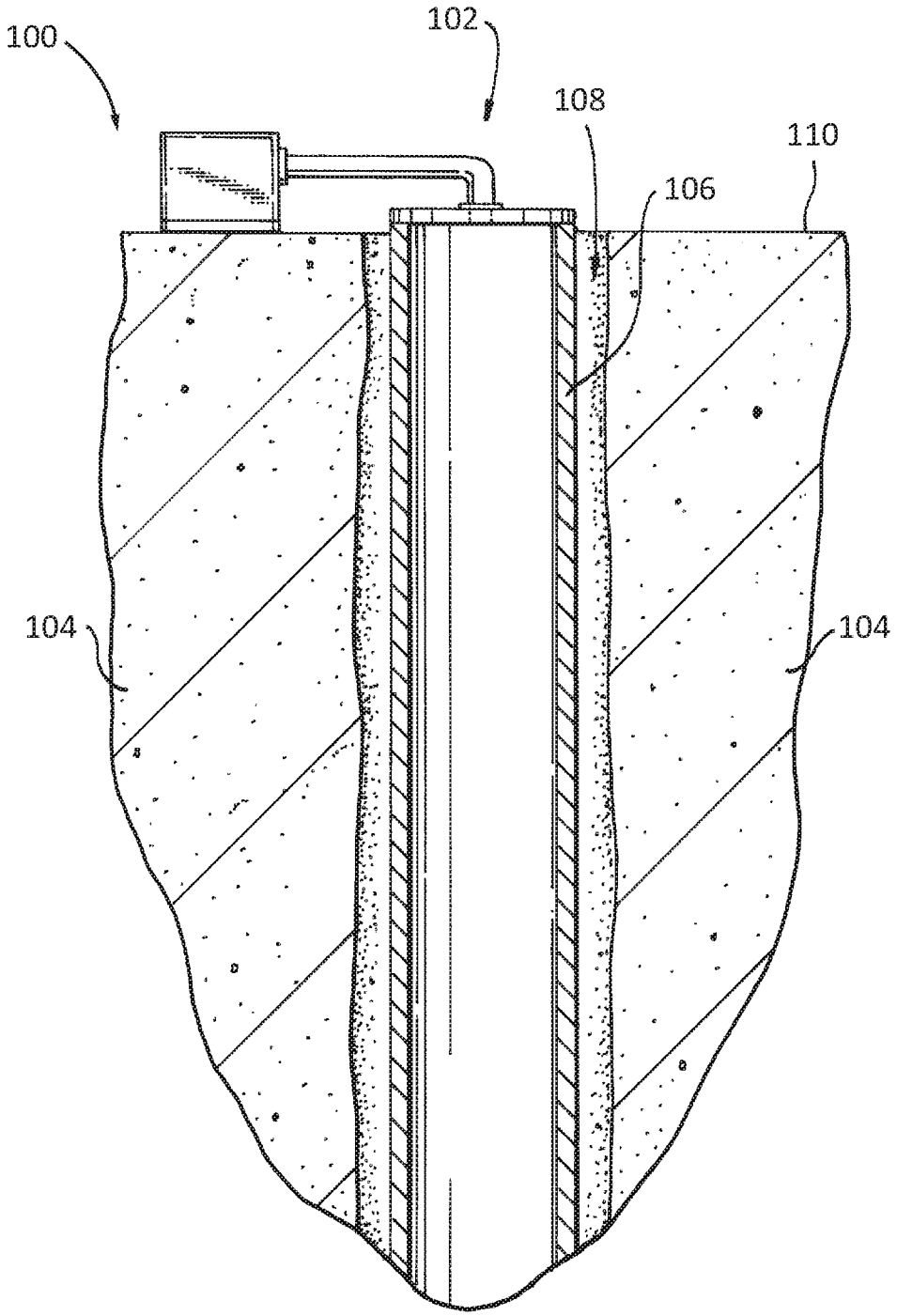
FIG. 1 is a schematic side elevation view of an exemplary embodiment of a system constructed in accordance with the present disclosure, showing the system connected to a well head for pumping a fracturing fluid containing proppant into a downhole formation.

Reference will now be made to the drawings wherein like reference numerals identify similar structural features or aspects of the subject disclosure. For purposes of explanation and illustration, and not limitation, a partial view of an exemplary embodiment of a system in accordance with the disclosure is shown in FIG. 1 and is designated generally by reference character 100. Other embodiments of systems in accordance with the disclosure, or aspects thereof, are provided in FIGS. 2-4, as will be described. The systems and methods described herein can be used for controlling flow of proppant on a continuous spectrum of flow rate and concentration, improving pump life, and providing automatic adjustment of pumps to follow a predetermined stimulation method and/or to compensate for failed pumps.

In a wellbore 102 through an earth formation 104, a casing 106 can be positioned in the wellbore 102 with an annulus 108 between the casing 106 and the formation 104. Downhole tools can be passed into the wellbore 102 through the casing 106, and production fluids, such as oil and gas, can be conveyed to the surface within the casing 106. The system 100 can be used to pump proppant from the surface 110 down casing 106 and ultimately into the earth formation 104.

Figure 2:
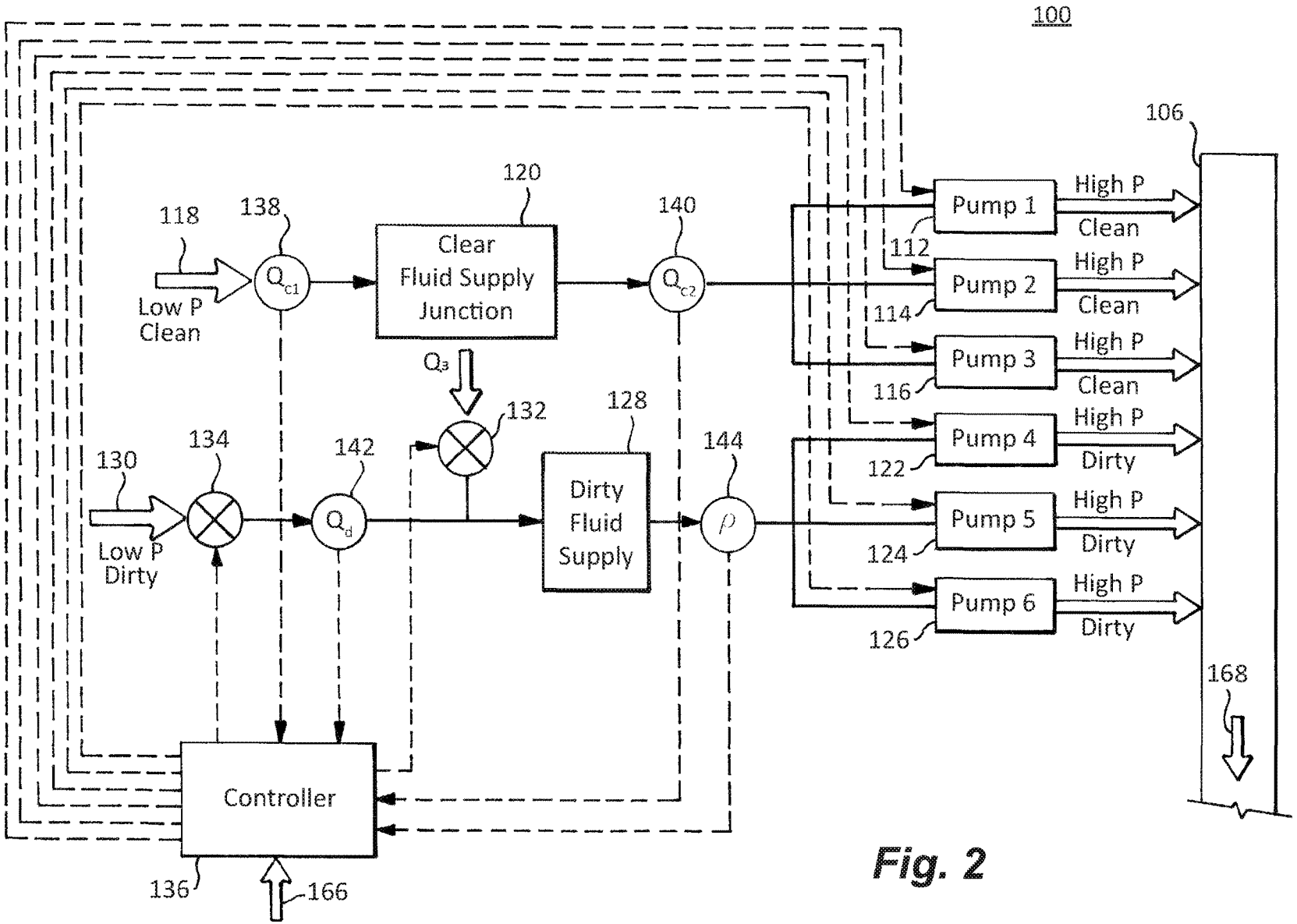
FIG. 2 is a schematic view of the system of FIG. 1, showing the controller, pumps, valves, and sensors for controlling downhole flow rate and concentration of proppant.

With reference now to FIG. 2, the system 100 includes a first plurality of pumps 112, 114, 116, referred to herein as clean pumps, connected to draw clean fluid, e.g., water, at low pressure from a clean fluid source 118 through a clean fluid supply junction 120. A second plurality of pumps 122, 124, 126, referred to herein as dirty pumps, is operatively connected to a dirty fluid supply 128 that receives proppant laden fluids at low pressure from a dirty fluid source 130, e.g., a blender. A first valve 132 is connected between the clean fluid supply junction 120 and the dirty fluid supply 128 for regulating clean fluid, e.g. water, to the dirty fluid supply 128. A second valve 134 is connected to regulate flow of a dirty fluid from the dirty fluid source 130 to the dirty fluid supply 128. A controller 136 is operatively connected to the first and second valves 132, 134, to the clean pumps 112, 114, 116, and to the dirty pumps 122, 124, 126, for controlling downhole concentration and flow rate of proppant through the combination of fluids from the clean fluid source 118 and the dirty fluid source 130 at a pressure provided by the pumps 112, 114, 116, 122, 124, 126. Broken lines in FIG. 2 indicate the wired or wireless connections between the controller 136 and the pumps 112, 114, 116, 122, 124, 126 and valves 132, 134.

The system 100 allows for variation of proppant concentration and flow rate across a continuous spectrum (as opposed to discrete or step-wise variation as in traditional systems where discrete or step-wise shifts of a gear transmission limit flow rate and the concentration settings are set by fluid sources and combined as high pressure fluids prior to or after entering the well head). The continuous rate spectrum of system 100 is produced by the pumps 112, 114, 116, 122, 124, 126. The continuous concentration spectrum (ranging from clean to pure proppant and carrier fluid, i.e., dirty) is produced by the valves 132, 134 and the pumps 112, 114, 116, 122, 124, 126. In FIG. 2, to supply pure dirty fluid to the casing 106 (which would be set by the blend of proppant), valve 132 can be closed and operation of cleans pumps 112, 114, 116 can cease. To supply pure clean fluid to casing 106, valve 134 can be shut (the valve 132 can be either open or closed and the dirty side pumps 122, 124, 126 can either run or not). In split flow types of operations as in traditional pumping systems, a proppant laden carrier fluid (dirty fluid) combines with the clean fluid after leaving the pumps and prior to going down hole as the fracturing fluid. In such traditional systems, the pump rates are adjusted and the concentration of fluid in the blender is changed to achieve desired down hole properties. Such traditional techniques produce the step-wise adjustments in flow and concentration of proppant, because (among other things) the traditional systems lack the continuous spectrum from the low pressure side valves (e.g. the valves 132 and 134 in FIG. 2). The traditional systems allow for changing the concentration by adjusting the mixture of proppant in the blender, which does not allow for a continuous spectrum of adjustment to downhole flow rates and proppant concentrations as in the present disclosure.

A plurality of sensors 138, 140, 142, 144 are operatively connected to the controller, as indicated by broken lines in FIG. 2, for feedback to control the downhole proppant concentration and flow rate on the fly. A first volume flow meter 138 is upstream of the clean fluid supply junction 120 for measuring total flow $Q_{c1}$ of clean water into the clean and dirty pumps 112, 114, 116, 122, 124, 126. A second volume flow meter 140 is included in a flow path fluidly connecting the clean fluid supply junction 120 to the clean pumps 112, 114, 116 for measuring flow $Q_{c2}$ of clean water into the clean pumps 112, 114, 116. A third volume flow meter 142 is included just downstream (or optionally just upstream) of the second valve 134 for measuring flow $Q_d$ of dirty fluid into the dirty fluid supply 128. The plurality of sensors includes a densometer 144 included in series downstream of the dirty fluid supply 128 and upstream of the dirty pumps 122, 124, 126 for measuring the fluid density and in-turn the concentration p of proppant. The controller 136 is connected to control each of the pumps 112, 114, 116, 122, 124, 126 individually, and is operatively connected to receive feedback from the first, second, and third volume flow meters 138, 140, 142 and the densometer 144 for closed-loop control of the pumps 112, 114, 116, 122, 124, 126.

Consider that $Q_3$ is the flow rate of clean water from the clean fluid supply junction 120 to the dirty fluid supply 128, and that the flow of $Q_3$ carries a concentration of proppant $C_1$ and $Q_d$ (the flow through flow meter 142) carries a proppant concentration $C_2$ of fluid then the measured concentration ρ is:

$$(Q_3*C_1+Q_d*C_2)/(Q_3+Q_d)=\rho$$

However, since the proppant concentration $C_1$ is zero for clean fluid, then this relation reduces to:

$$\frac{(Q_d C_2)}{Q_3 + Q_d} = \rho$$

To achieve a maximum concentration of proppant for the system, then the valve at $Q_3$ could restrict flow to achieve:

$$\frac{Q_d C_2}{Q_d} = C_2 = \rho$$

Or a mass flow rate of proppant out of the dirty side of the system 100:

$$\dot{m}=\rho*Q_d$$

Thus the downhole concentration is:

$$\frac{\rho Q_d}{Q_d + Q_{c2}} = C_{downhole}$$

With the same mass flow rate m. The calculated concentration ρ is actively compared to the concentration measured at the densometer 144 for feedback control of concentration.

The parallel pumps 122, 124, 126 in series with the supply share the flow rate load according to:

$$Q_d=Q_{pump4}+Q_{pump5}+Q_{pump6},$$

for the dirty side, and:

$$Q_{c2}=Q_{pump1}+Q_{pump2}+Q_{pump3},$$

for the clean side.

Through this example, it becomes apparent how the system 100 can be used to set a mass flow rate of proppant and overall fluid volume flow rate to achieve desired pressures and fluid concentrations. As further discussed below, system 100 can ensure that Qa and Qc2 are always achieved if a pump system fails or is added. This allows system 100 to adjust proppant concentration and flow rate downhole during the pumping operation to an infinite degree through adjusting the motor speed (described further below), valves 132, 134, or any combination.

The controller 136 is configured, e.g., with machine readable instructions, to compare a desired downhole volume flow rate and mass flow rate of proppant laden fluid (the fracturing fluid) to the actual produced fracturing fluid based on the feedback from the first, second, and third volume flow meters 138, 140, 142 and the densometer 144. The controller 136 is configured, e.g., with machine readable instructions, to adjust individual flow rates of the clean and dirty pumps 112, 114, 116, 122, 124, 126 and to adjust the valves 132, 134 to make the actual downhole flow concentration and flow rate of proppant match the desired downhole concentration and flow rate of proppant.

Figure 3:
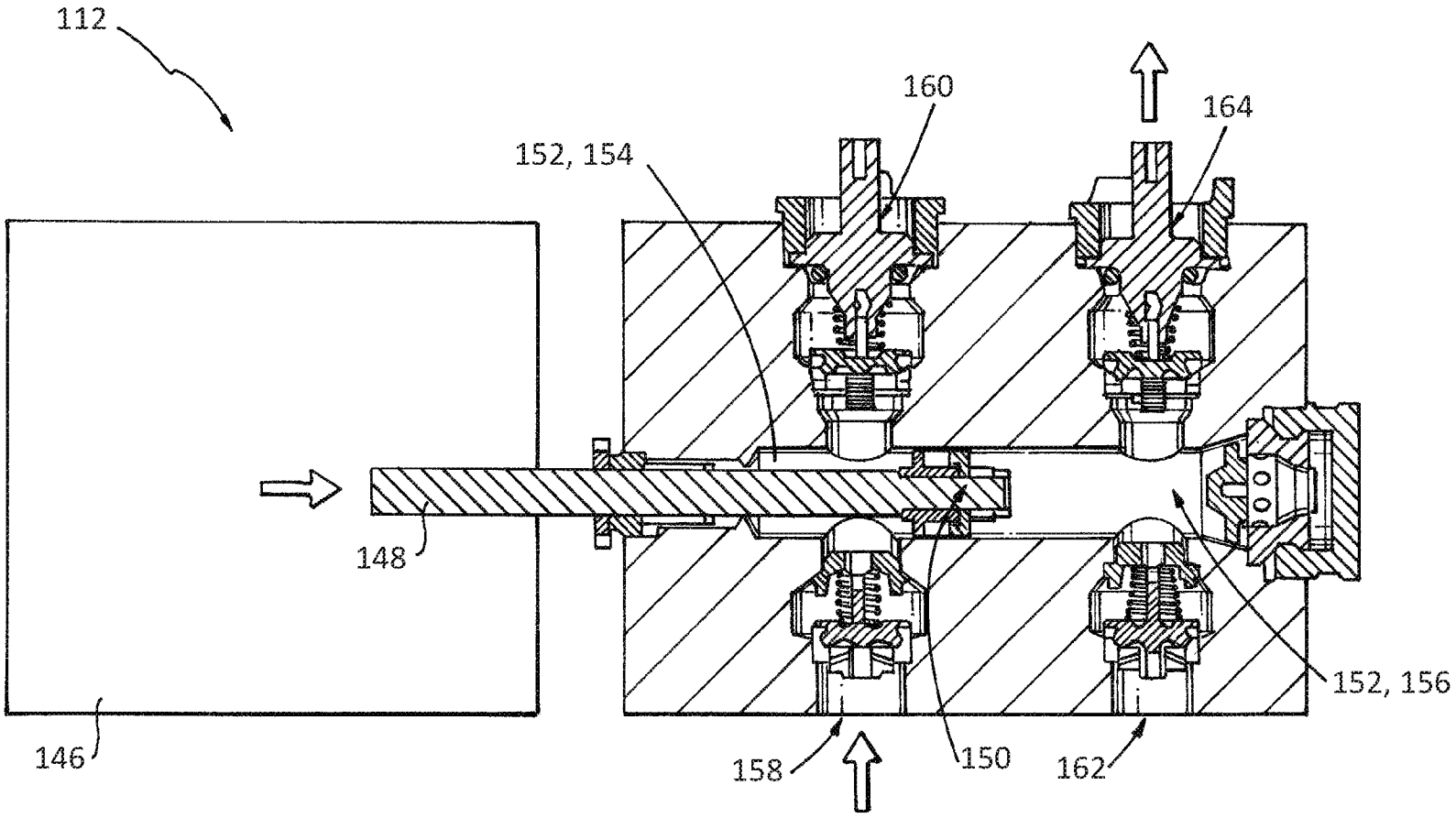
FIG. 3 is a schematic view of one of the pumps of the system of FIG. 1, schematically showing the fluid flow in the first stroke direction of the linear motor.
Figure 4:
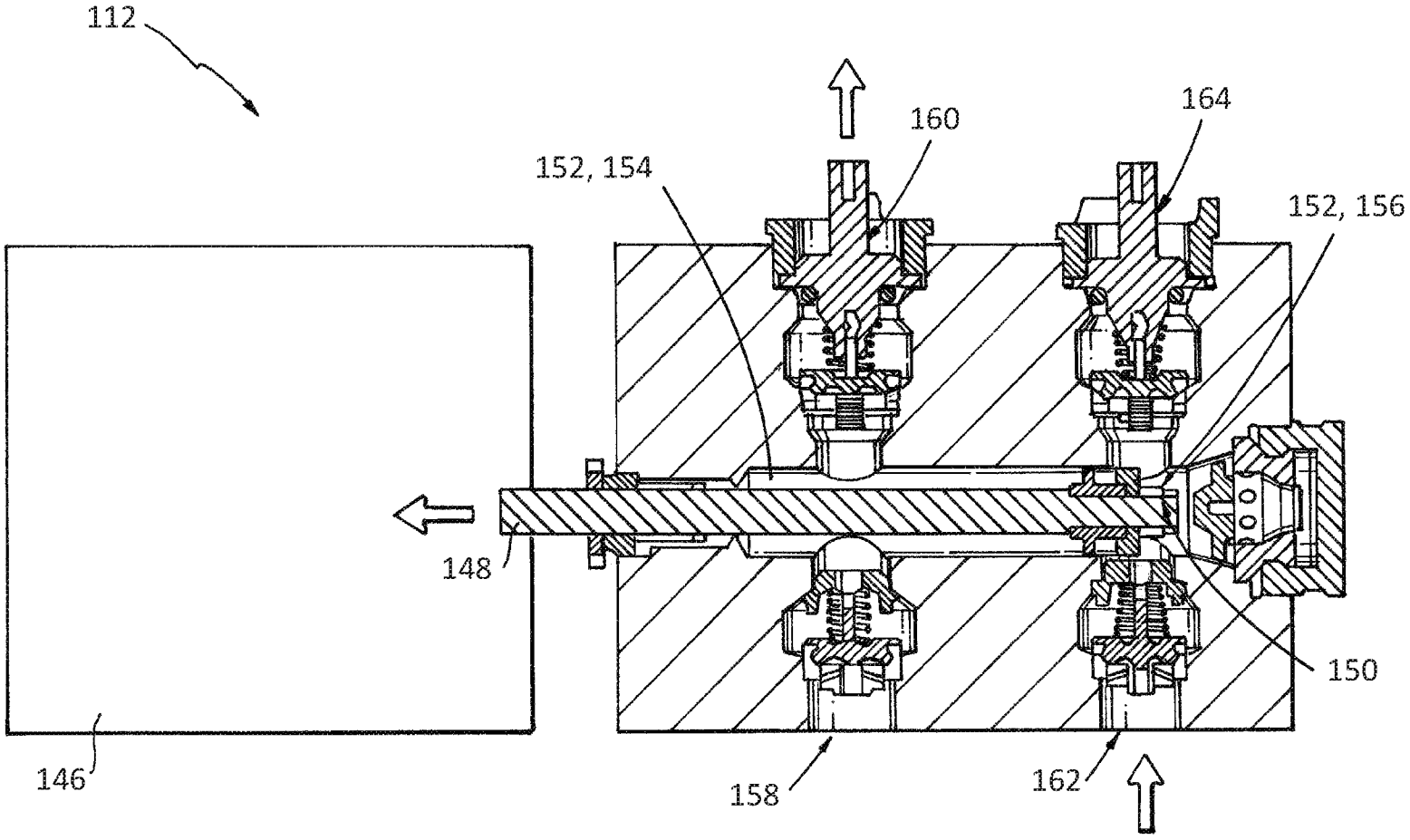
FIG. 4 is a schematic view of the pump of FIG. 3, schematically showing the fluid flow in the second stroke direction of the linear motor.

With reference now to FIG. 3, each of the pumps 112, 114, 116, 122, 124, 126 includes an electric motor 146, e.g., a linear electric motor (LEM), a linear induction motor (LIM), or a rotary electric motor connected to a transmission for converting rotary to linear motion. While FIG. 4 only shows one pump 112 for sake of clarity, those skilled in the art will readily appreciate that pumps 114, 116, 122, 124, 126 can all be configured similar to pump 112. The motor 146 includes a rod 148 that is connected to a respective pump piston 150 that is slidingly engaged in piston chamber 152. The cross-sectional view of FIG. 3 can represent a single section of a pump with one or more similar parallel sections to form a duplex, triplex, quintuplex, or the like.

With continued reference to FIG. 3, each of the pumps 112, 114, 116, 122, 124, 126 is a double acting pump. This allows the pump to perform pumping work in both directions, reducing the number of strokes for a given volume of flow and extending the pump life. The pump piston 150 divides the piston chamber 152 into a first end 154 and a second end 156. A first one-way suction valve 158 is in fluid communication with the first end 154 of the piston chamber, configured to admit fluid into the first end 154 of the piston chamber 152 therethrough. A first one-way discharge valve 160 is in fluid communication with the first end 154 of the piston chamber 152, configured to discharge fluid from the first end 154 of the piston chamber 152 therethrough. A second one-way suction valve 162 is in fluid communication with the second end 156 of the piston chamber 152, configured to admit fluid into the second end of the piston chamber therethrough. A second one-way discharge valve 164 is in fluid communication with the second end 164 of the piston chamber 152, configured to discharge fluid from the second end 156 of the piston chamber 152 therethrough.

Figure 5:
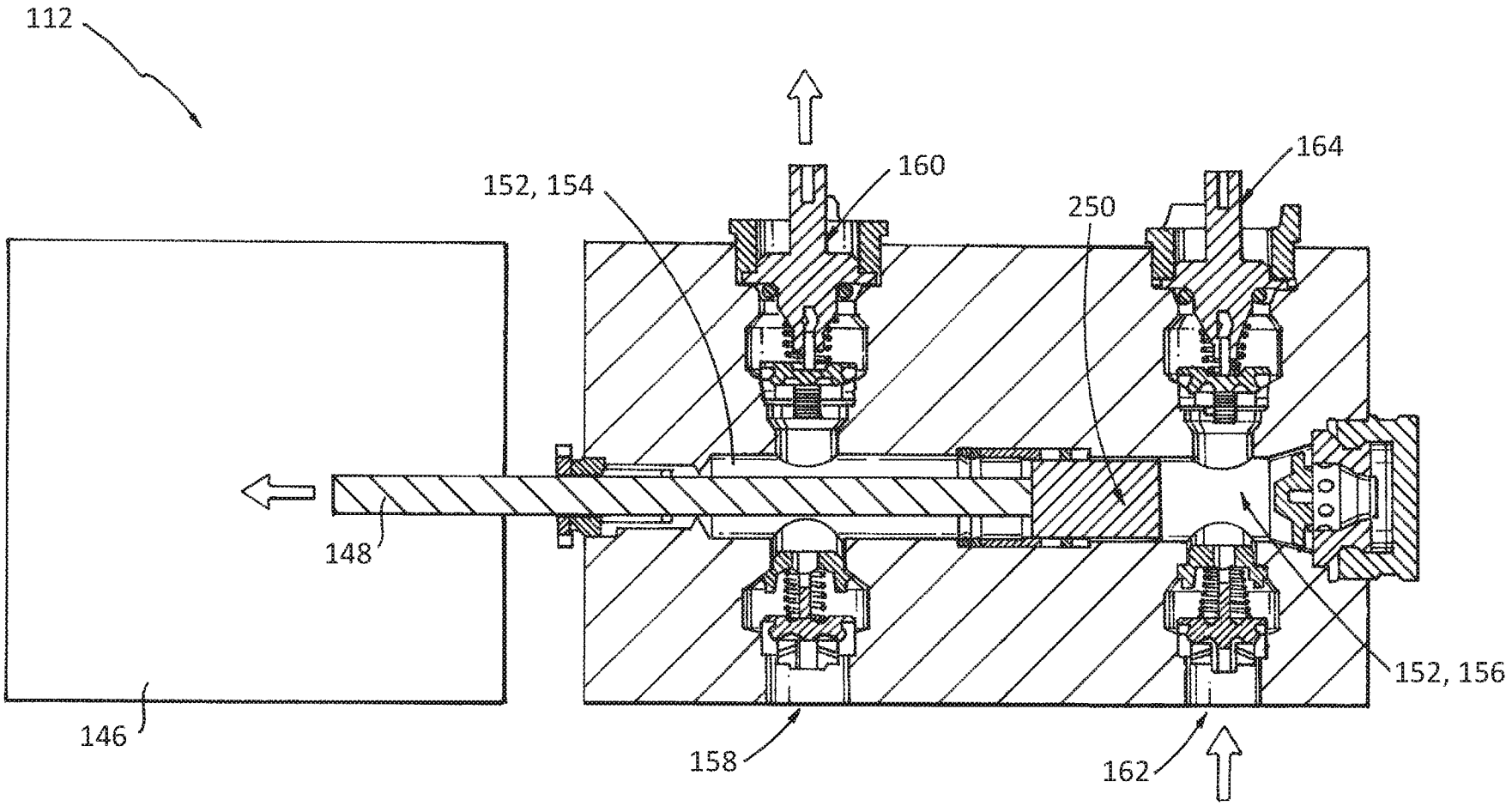
FIG. 5 is a schematic view of the pump of FIG. 3, showing a plunger in place of the piston.

The suction valves 158 and 162 can both draw fluid from a common source, e.g., connecting to the source through a y-connection. The discharge valves 160 and 164 can both feed into the same destination, e.g., connecting through another y-connection. FIG. 3 shows the motor stroking in a first direction, indicated by the large right-facing arrow. In this stroke direction, the piston pushes fluid out of the second end 156 of the piston chamber 152 through discharge valve 164 and draws fluid through the suction valve 158 into the first end 154 of the piston chamber 152 as indicated in FIG. 3 by the large vertical arrows. In the reverse stroke direction, shown with the large left pointing arrow in FIG. 4, the piston 150 drives fluid out of the first end 154 of the piston chamber 152 through discharge valve 160, and draws fluid into the second end 156 of the piston chamber 152 through the suction valve 162, as indicated by the large vertical arrows. Due to the presence of the rod 148 in the first end 154 of the piston chamber 152, the piston 150 should travel at a different speed in the first stroke direction of FIG. 3 than in the second stroke direction of FIG. 4 to maintain a given flow rate through the pump 112. The need to actuate the piston at two different speeds depending on which direction the piston is traveling is readily accommodated by the fact that the motor 146 is electric. Those skilled in the art will readily appreciate that a non-electric engine/transmission/crankshaft can be used to produce differing speeds in the two directions without departing from the scope of this disclosure; however an electric motor can advantageously produce this motion in a straightforward manner. The pump 112 in FIGS. 3-4 includes a piston 150, however as shown in FIG. 5, the piston 150 can be replaced with a plunger 250 for a plunger pump configuration, which otherwise operates similar to the piston pump configuration of FIGS. 3-4.

While shown and described in the exemplary context of double acting single piston pumps, those skilled in the art will readily appreciate that any suitable type of pump such as double acting plunger pumps, single acting plunger pumps including but not limited to triplex pumps, quintuplex pumps, centrifugal pumps, progressive cavity pumps, or any assortment or combination of the foregoing, can be used without departing from the scope of this disclosure. While electric linear motors are advantageous, those skilled in the art will readily appreciate that with lag expected, any other suitable type of drive such as standard engines, transmissions, gears, crankshafts, connecting rod drives, and the like, can be used without departing from the scope of this disclosure, although some set ups may limit the range of adjustment to discrete steps.

With reference again to FIG. 2, the controller 136 can include machine readable instructions configured to cause the controller 136 to follow a programmed stimulation method that varies downhole proppant flow rate and/or concentration as a function of time. The programmed stimulation method can be supplied as a program or sequence of commands to be executed by the controller. In addition to or in lieu of following programmed input, the controller 136 can receive on-the-fly user input for changing the desired downhole proppant flow rate and concentration. Programmed and/or user input to the controller 136 is indicated in FIG. 2 with the arrow 166. Regardless of whether the desired downhole flow rate and concentration of proppant are from a predetermined stimulation program or from on-the-fly user input, the controller 136 adjusts the pumping of the pumps 112, 114, 116, 122, 124, 126 to match the actual downhole flow rate and concentration of proppant (indicated in FIG. 2 with the large arrow 168) with the desired flow rate and concentration. The controller 136 can determine actual downhole concentration and flow rate of proppant based on measurements from the first, second, and third volume flow meters 138, 140, 142 and the densometer 144. Adjusting to match an actual downhole flow rate and concentration of proppant with a desired flow rate and concentration of proppant includes the controller 136 varying electrical power to at least one of the respective motors 146 (shown in FIGS. 2-4) to adjust pumping rates and/or adjusting valves 132,134 to adjust proppant concentration.

If one or more of the pumps 112, 114, 116, 122, 124, 126 fails, the controller 136 can automatically adjust the remaining pumps 112, 114, 116, 122, 124, 126 that are still operational to maintain the desired flow rate and concentration of proppant without requiring user input. The desired flow properties can be maintained by adjusting any remaining operational pumps 112, 114, 116, 122, 124, 126 and/or the valves 132, 134 which can include adjusting pump speed for a given operation pump 112, 114, 116, 122, 124, 126 and/or valve position of the valves 132, 134. If one clean pump, e.g., pump 112, has failed, the controller 136 can increase and balance flow among operational clean pumps, e.g., pumps 114 and 116. Similarly, if one of the dirty pumps, e.g., pump 122, fails, the controller 136 can increase and balance flow among operation dirty pumps, e.g., pumps 124 and 126.

Dedicating some pumps to be clean pumps 112, 114, 116 and some pumps to be dirty pumps 122, 124, 126 ensures that at least the clean pumps 112, 114, 116 will be isolated from proppant. The clean pumps 112, 114, 116 will therefore have extended service lives between servicing, and fluid end consumables costs and whole fluid end costs are reduced. While shown and described in the exemplary context of having three clean pumps 112, 114, 116 and three dirty pumps 122, 124, 126, those skilled in the art will readily appreciate than any suitable number of clean and dirty pumps can be used without departing from the scope of this disclosure.

Systems and methods as disclosed herein do not rely on user monitoring to check pump performance or to orchestrate pump rates to follow a stimulation method for a given hydraulic fracturing job. Placing pumps in a control system where each pump self-regulates and communicates with the collective regulation, if a pump were to fail, allows the other pumps to immediately react and adjust with no downtime. If a pump is swapped during a job, or another pump is sitting on standby, as soon as a replacement enters service, the pumps can automatically return to their original parameters. If used with accelerometers to measure excessive pump movement and/or with a system to monitor cavitation, any problematic pump can decrease output to a safe level with the other pumps compensating for the duration of the job. This can prevent unnecessary pump failure as a result of less than ideal pumping conditions, while keeping the job running uninterrupted, and without requiring human input. Using electric motor driven pumps in combination with the valve arrangement to regulate the mixture of clean and dirty flows to the dirty side of the pumping system, there is an infinite number of pressure, flow rate, and proppant concentration combinations for a single system in a single job (as opposed to being limited to discrete combinations as in traditional systems). Using electric motors to drive the pumps can eliminate the need for transmission, gear sets, and roller bearings, as they would otherwise be supplanted with the drive mechanism specific to the electric motor.

Accordingly, as set forth above, the embodiments disclosed herein may be implemented in a number of ways. For example, in general, in one aspect, the disclosed embodiments relate to a system. The system includes a first plurality of pumps connected to draw from a clean fluid supply junction. A second plurality of pumps is operatively connected to a dirty fluid supply. The dirty fluid can be sourced from a connected container holding a premixed proppant suspension or a blender, for example. A first valve is connected between the clean fluid supply junction and the dirty fluid supply for supplying clean fluid to the dirty fluid supply to create a particular fluid mixture. A second valve is connected to feed a dirty fluid to the dirty fluid supply. A controller is operatively connected to the first and second valves and to the first and second pluralities of pumps for controlling downhole concentration and flow rate of proppant from the dirty fluid supply, wherein downhole concentration and flow rate are varied across a continuous spectrum.

In general, in another aspect, the disclosed embodiments relate to a method. The method includes controlling downhole concentration and flow rate of proppant, wherein downhole concentration and flow rate are varied across a continuous spectrum.

In accordance with any of the foregoing embodiments, a plurality of sensors can be operatively connected to the controller for feedback to control the downhole concentration and flow rate during the pumping operation. The plurality of sensors can include a first volume flow meter upstream of the clean fluid supply junction for measuring total flow of clean water into the first and second pluralities of pumps, a second volume flow meter in a flow path fluidly connecting the clean fluid supply junction to the first plurality of pumps for measuring flow of clean water into the first plurality of pumps, a third volume flow meter downstream of the second valve for measuring flow of dirty fluid into the dirty fluid supply, and a densometer in series with the dirty fluid supply upstream of the second plurality of pumps for measuring concentration of proppant. The controller can be connected to control each of the pumps in the first and second pluralities of pumps individually, and can be operatively connected to receive feedback from the first, second, and third volume flow meters and the densometer for closed-loop control of the pumps.

The controller can be configured to compare a desired downhole flow concentration and flow rate of proppant mixed with a water mixture to actual downhole flow concentration and flow rate of proppant mixed with water mixture based on the feedback from the first, second, and third volume flow meters and the densometer. The controller can be configured to adjust individual flow rates of the first and second pluralities of pumps and/or to adjust the first and second valves to make the actual downhole flow concentration and flow rate match the desired downhole concentration and flow rate.

In accordance with any of the foregoing embodiments, each of the pumps in the first and second plurality of pumps can include an electric motor. The electric motor can be connected to produce a linear motion in the respective pump and/or the electric motor can be a linear motor. The linear motor can include a rod that is connected to a respective pump piston slidingly engaged in piston chamber, wherein the pump piston divides the piston chamber into a first end and a second end. A first one-way suction valve can be in fluid communication with the first end of the piston chamber, configured to admit fluid into the first end of the piston chamber therethrough. A first one-way discharge valve can be in fluid communication with the first end of the piston chamber, configured to discharge fluid from the first end of the piston chamber therethrough. A second one-way suction valve can be in fluid communication with the second end of the piston chamber, configured to admit fluid into the second end of the piston chamber therethrough. A second one-way discharge valve can be in fluid communication with the second end of the piston chamber, configured to discharge fluid from the second end of the piston chamber therethrough.

In accordance with any of the foregoing embodiments, the controller can include machine readable instructions configured to cause the controller to follow a programmed stimulation method that varies downhole proppant flow rate and/or concentration as a function of time.

In accordance with any of the foregoing embodiments, controlling downhole concentration and flow rate can include receiving sensor feedback into a controller from a plurality of sensors to control a first plurality of pumps operatively connected to a clean fluid supply junction and a second plurality of pumps operatively connected to a dirty fluid supply to adjust to match an actual downhole flow rate and concentration of proppant with a desired flow rate and concentration of proppant. Receiving sensor feedback can include receiving sensor feedback from a first, second and third flow meter, and from a densometer as described above. The method can include determining actual downhole concentration and flow rate of proppant based on measurements from the first, second, and third volume flow meters and the densometer. Adjusting to match an actual downhole flow rate and concentration of proppant with a desired flow rate and concentration of proppant can include the controller varying electrical power to at least one of the respective motors.

In accordance with any of the foregoing embodiments, each pump in the first and second pluralities of pumps can be a double acting pump and wherein the electric motor is connected to produce linear motion in the respective pump. Controlling a first plurality of pumps operatively connected to a clean fluid supply junction and a second plurality of pumps operatively connected to a dirty fluid supply can include pumping fluid from each pump in the first and second pluralities of pumps in both linear directions of the respective linear motor. Pumping fluid from each pump in the first and second pluralities of pumps in both linear directions of the respective linear motor can include actuating the respective motor at a first rate in a first stroke direction and actuating the respective motor at a different rate in a second stroke direction reverse of the first stroke direction.

In accordance with any of the foregoing embodiments, matching an actual downhole flow rate and concentration of proppant with a desired flow rate and concentration of proppant can include matching a desired flow rate that changes as governed by a programmed stimulation method that varies downhole proppant flow rate and/or concentration as a function of time. It is also contemplated that the method can include receiving user input for on-the-fly desired flow rate and concentration of proppant, wherein matching an actual downhole flow rate and concentration of proppant with a desired flow rate and concentration of proppant includes matching a desired flow rate that changes as governed by a the on-the-fly desired flow rate and concentration of proppant.

In accordance with any of the foregoing embodiments, if one or more of the pumps in the first and second pluralities of pumps fails, the method can include automatically adjusting remaining operational pumps in the first and second pluralities of pumps to maintain the desired flow rate and concentration of proppant without requiring user input.

Adjusting remaining operational pumps can include at least one of adjusting pump speed and/or adjusting a pump valve or choke.

In accordance with any of the foregoing embodiments, the method can include balancing flow among operational pumps in the first plurality of pumps with one another, and balancing flow among operation pumps in the second plurality of pumps with one another.

The methods and systems of the present disclosure, as described above and shown in the drawings, provide for pumping proppant into downhole formations with superior properties including controlling flow of proppant on a continuous spectrum of flow rate and concentration, improved pump life, and automatic adjustment of pumps to follow a predetermined stimulation method and/or to compensate for failed pumps. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system, comprising:

a first plurality of pumps connected to draw from a clean fluid supply junction;

a second plurality of pumps operatively connected to a dirty fluid supply;

a first valve connected between the clean fluid supply junction and the dirty fluid supply for supplying clean fluid to the dirty fluid supply;

a second valve connected to feed a dirty fluid to the dirty fluid supply;

a controller operatively connected to the first and second valves and to the first and second pluralities of pumps for controlling downhole concentration and flow rate of proppant from the dirty fluid supply, wherein the downhole concentration and flow rate of proppant are varied across a continuous spectrum; and a plurality of sensors operatively connected to the controller for feedback to control the downhole concentration and flow rate of proppant during the pumping operation, wherein the plurality of sensors includes:

a first volume flow meter upstream of the clean fluid supply junction for measuring total flow of clean fluid into the first and second pluralities of pumps;

a second volume flow meter in a flow path fluidly connecting the clean fluid supply junction to the first plurality of pumps for measuring flow of clean fluid into the first plurality of pumps;

a third volume flow meter downstream of the second valve for measuring flow of the dirty fluid into the dirty fluid supply; and a densometer in series with the dirty fluid supply upstream of the second plurality of pumps for measuring concentration of proppant.

2. The system as recited in claim 1, wherein the controller includes machine readable instructions configured to cause the controller to follow a programmed stimulation method that varies the downhole concentration and flow rate of proppant as a function of time.

3. The system as recited in claim 1, further comprising if one or more of the pumps in the first and second pluralities of pumps fails, automatically adjusting the remaining operational pumps in the first and second pluralities of pumps to maintain the desired flow rate of proppant and concentration of proppant without requiring user input.

4. The system as recited in claim 1, wherein each pump in the first plurality of pumps and each pump in the second plurality of pumps includes an electric motor.

5. The system as recited in claim 4, wherein at least one of: the electric motor is connected to produce linear motion in each of the respective pumps; and/or the electric motor is a linear motor.

6. The system as recited in claim 5, wherein the linear motor includes a rod that is connected to a respective pump piston slidingly engaged in piston chamber, wherein the pump piston divides the piston chamber into a first end and a second end, further comprising:

a first one-way suction valve in fluid communication with the first end of the piston chamber, configured to admit a first fluid into the first end of the piston chamber therethrough;

a first one-way discharge valve in fluid communication with the first end of the piston chamber, configured to discharge the first fluid from the first end of the piston chamber therethrough;

a second one-way suction valve in fluid communication with the second end of the piston chamber, configured to admit a second fluid into the second end of the piston chamber therethrough; and a second one-way discharge valve in fluid communication with the second end of the piston chamber, configured to discharge the second fluid from the second end of the piston chamber therethrough;

wherein the first fluid and the second fluid is in fluid communication with same fluid source; and wherein the fluid source is the clean fluid supply or the dirty fluid supply.

7. The system as recited in claim 1, wherein the controller is connected to control each pump in the first plurality of pumps and each pump in the second plurality of pumps, and is operatively connected to receive feedback from the first, second, and third volume flow meters and the densometer for closed-loop control of the pumps.

8. The system as recited in claim 7, wherein the controller is configured to:

compare a desired downhole flow concentration and flow rate of proppant mixed with a water mixture to actual downhole flow concentration and flow rate of proppant mixed with the water mixture based on the feedback from the first, second, and third volume flow meters and the densometer; and adjust individual flow rates of the first and second pluralities of pumps and/or adjust the first and second valves to make the actual downhole flow concentration and flow rate of proppant with the water mixture match the desired downhole flow concentration and flow rate of proppant with the water mixture.

9. The system as recited in claim 8, wherein the adjusting to match the actual downhole flow concentration and flow rate of proppant with the water mixture with the desired downhole flow concentration and flow rate of proppant with the water mixture includes matching the desired downhole flow concentration and flow rate of proppant mixed with the water mixture that changes as governed by a programmed stimulation method that varies downhole proppant flow rate and/or concentration as a function of time.

10. The system as recited in claim 7, wherein each pump in the first plurality of pumps and each pump in the second plurality of pumps includes an electric motor.

11. The system as recited in claim 10, wherein at least one of:

the electric motor is connected to produce linear motion in each of the respective pumps; and/or the electric motor is a linear motor.

12. A method, comprising:

controlling downhole concentration and flow rate of proppant, wherein the downhole concentration and flow rate of proppant are varied across a continuous spectrum, wherein the controlling downhole concentration and flow rate of proppant includes: receiving sensor feedback into a controller from a plurality of sensors; controlling a first plurality of pumps operatively connected to a clean fluid supply junction, a second plurality of pumps operatively connected to a dirty fluid supply, a first valve connected between the clean fluid supply junction and the dirty fluid supply and a second valve connected to feed a dirty fluid to the dirty fluid supply to match an actual downhole flow rate and concentration of proppant with a desired flow rate and concentration of proppant, and wherein the receiving sensor feedback includes receiving sensor feedback from:

a first volume flow meter upstream of the clean fluid supply junction for measuring total flow of clean fluid into the first and second pluralities of pumps;

a second volume flow meter in a flow path fluidly connecting the clean fluid supply junction to the first plurality of pumps for measuring flow of clean fluid into the first plurality of pumps;

a third volume flow meter downstream of the second valve for measuring flow of the dirty fluid into the dirty fluid supply; and a densometer in series with the dirty fluid supply upstream of the second plurality of pumps for measuring concentration of proppant, wherein the method further comprising determining the actual downhole concentration and flow rate of proppant based on measurements from the first, second, and third volume flow meters and the densometer.

13. The method as recited in claim 12, wherein the step of controlling to match the actual downhole flow rate and concentration of proppant with the desired flow rate and concentration of proppant includes matching the desired flow rate and concentration of proppant that changes as governed by a programmed stimulation method that varies downhole proppant flow rate and/or concentration as a function of time.

14. The method as recited in claim 12, further comprising receiving user input for updated desired flow rate and concentration of proppant, wherein the step of controlling to match the actual downhole flow rate and concentration of proppant with the desired flow rate and concentration of proppant includes matching the desired flow rate and concentration of proppant that changes as governed by updated desired flow rate and concentration of proppant.

15. The method as recited in claim 12, further comprising:

balancing flow among operational pumps in the first plurality of pumps with one another; and balancing flow among operational pumps in the second plurality of pumps with one another.

16. The method as recited in claim 12, further comprising if one or more of the pumps in the first and second pluralities of pumps fails, automatically adjusting remaining operational pumps in the first and second pluralities of pumps to maintain the desired flow rate and concentration of proppant without requiring user input.

17. The method as recited in claim 16, wherein the step of automatically adjusting remaining operational pumps in the first and second pluralities of pumps includes at least one of adjusting pump speed and/or adjusting a pump valve or choke.

18. The method as recited in claim 12, wherein each pump in the first plurality of pumps and each pump in the second plurality of pumps includes an electric motor, wherein the step of controlling to matching the actual downhole flow rate and concentration of proppant with the desired flow rate and concentration of proppant includes the controller varying electrical power to at least one of the respective motors.

19. The method as recited in claim 18, wherein each pump in the first plurality of pumps and each pump in the second plurality of pumps is a double acting pump and wherein the respective electric motor, being a linear motor, is connected to produce linear motion in each of the respective pumps, wherein controlling each pump in the first plurality of pumps operatively connected to the clean fluid supply junction and each pump in the second plurality of pumps operatively connected to the dirty fluid supply includes pumping fluid from each pump in the first plurality of pumps and each pump in the second plurality of pumps in both linear directions of the respective linear motor.

20. The method as recited in claim 19, wherein the step of pumping fluid from each pump in the first plurality of pumps and each pump in the second plurality of pumps in both linear directions of the respective linear motor includes actuating the respective linear motor at a first rate in a first stroke direction and actuating the respective linear motor at a different rate in a second stroke direction reverse of the first stroke direction.

* * * * *